US007714711B1

(12) United States Patent
Daniel

(10) Patent No.: US 7,714,711 B1
(45) Date of Patent: May 11, 2010

(54) EMERGENCY REPORTING INITIATED BY COVERT ALARM LOCATOR APPARATUS

(76) Inventor: Sayo Isaac Daniel, 848 Brickell Key Dr., #3402, Miami, FL (US) 33131

( * ) Notice: Subject to any disclaimer, the term of this patent is extended or adjusted under 35 U.S.C. 154(b) by 330 days.

(21) Appl. No.: 11/849,909

(22) Filed: Sep. 4, 2007

Related U.S. Application Data

(63) Continuation-in-part of application No. 11/626,356, filed on Jan. 23, 2007, and a continuation-in-part of application No. 11/619,189, filed on Jan. 2, 2007, and a continuation-in-part of application No. 11/560,762, filed on Nov. 16, 2006, now abandoned, and a continuation-in-part of application No. 10/979,894, filed on Nov. 1, 2004, now Pat. No. 7,265,666.

(51) Int. Cl.
*G08B 1/08* (2006.01)

(52) U.S. Cl. ..... 340/539.13; 340/539.1; 340/539.15

(58) Field of Classification Search ..... 340/539.1, 340/539.11, 539.13, 539.2, 539.24, 539.21, 340/539.22
See application file for complete search history.

(56) References Cited

U.S. PATENT DOCUMENTS

| | | | | |
|---|---|---|---|---|
| 6,788,200 | B1 * | 9/2004 | Jamel et al. | 340/539.13 |
| 7,265,666 | B2 * | 9/2007 | Daniel | 340/539.11 |
| 2006/0103538 | A1 * | 5/2006 | Daniel | 340/574 |

* cited by examiner

*Primary Examiner*—Travis R Hunnings
(74) *Attorney, Agent, or Firm*—Sanford Jay Asman

(57) ABSTRACT

An article of footwear contains an integrated location determining device, such as a GPS receiver, together with an automatic alarm activation module ("AAAM") which is capable of initiating an alarm activation indicative of the footwear having been removed from the wearer and having been "tossed" away by an abductor of the wearer. In the preferred embodiment of the invention, the AAAM includes at least one accelerometer which can sense, and respond to, acceleration forces ("XYZ" forces) which exceed a predetermined range which would be expected during "normal" wearing and usage of the footwear. In an alternative embodiment the AAAM can be programmed, either externally, or by the wearer, to override the AAAM circuitry to disable it from automatically generating an alarm signal, whereby the wearer has the ultimate control over whether the footwear will only generate an alarm signal manually.

10 Claims, 2 Drawing Sheets

EMERGENCY REPORTING INITIATED BY COVERT ALARM LOCATOR APPARATUS

CROSS-REFERENCE TO RELATED APPLICATIONS

The present application is a continuation-in-part of U.S. patent application Ser. No. 10/979,894 entitled FOOTWEAR COVERT ALARM AND LOCATOR APPARATUS filed by Sayo Isaac Daniel on Nov. 1, 2004, to be issued as U.S. Pat. No. 7,265,666 on Sep. 4, 2007; Ser. No. 11/560,762, entitled HAND WORN ATTIRE WITH BUILT-IN GPS RECEIVER, filed Nov. 16, 2006; Ser. No. 11/619,189 entitled FOOTWEAR WITH INTEGRATED VIDEO GAMING APPARATUS, filed Jan. 2, 2007; and Ser. No. 11/626,356 entitled BACKPACK HAVING A COVERT ALARM AND LOCATOR APPARATUS, filed Jan. 23, 2007, all by the present inventor, the priority of all of which are claimed, and the contents of all of which are hereby incorporated by reference.

BACKGROUND OF THE INVENTION

The present invention relates to an article of footwear, such as an athletic shoe. In particular, the present invention relates to a piece of footwear which includes a location determining means, such as a global positioning system ("GPS") receiver along with a covert alarm activation button which can be selectively activated by the wearer of the footwear to send out an alarm signal which is encoded with the location (e.g., latitude and longitude) of the wearer of the footwear. More particularly, the present invention relates to an automatic emergency override system which allows the circuitry contained in the footwear to initiate the transmission of an encoded alarm signal.

As described in the parent application of the present application, footwear containing a GPS receiver, a transmission means (such as a cellular phone module), and a covert alarm activation button can be used to provide the wearer of the footwear with the ability to selectively transmit a "find me" alarm signal which has been encoded with the identification of the wearer of the footwear, along with the location of the footwear at the time that the alarm signal is transmitted.

While the foregoing technology has a number of advantages over the prior art tracking devices which are "always on", whereby the privacy of the wearer is impeded while the battery life of the tracking and transmission circuitry is limited, a possible problem which the present invention is intended to solve relates to the fact that if the wearer of the footwear described in the parent application was to be abducted, and the abductor realized that the wearer was wearing the footwear, the abductor might try to remove the footwear from the wearer and dispose of it before the wearer could activate the button which sends out the location encoded alarm signal in an attempt to prevent the wearer from thereby seeking assistance.

In view of the foregoing potential issue with the footwear described in the parent application a system for preventing an abductor from taking advantage of the fact that the alarm apparatus requires affirmative activation in order to maintain both battery life and the privacy of the wearer would be desirable.

SUMMARY OF THE INVENTION

In accordance with the present invention, an article of footwear includes a sole portion and an upper portion. The article of footwear is designed to house, in its sole portion, an electronics package including a location determining module, such as a GPS receiver capable of receiving location data from the constellation of GPS satellites. In addition, the article of footwear includes an automated activation means capable of sensing, and reacting to, one or more conditions indicative of the removal of the shoe from the wearer, such that the automated activation means could activate the transmission of a location encoded alarm signal, without additional user intervention.

In a preferred embodiment of the invention, the automated activation means is comprised of an accelerometer which senses the acceleration to which the footwear is subjected. While footwear worn in normal use is subject to acceleration forces, such forces are typically limited to values associated with running and walking, or even to such acceleration as the wearer might subject to when driving.

In the case of abduction of the wearer, the acceleration forces to which the footwear is subject are likely to exceed those normally encountered by the footwear when it is worn. In particular, if the inventive footwear was to be removed from the wearer and thrown away by the abductor, it would be subject to both horizontal and vertical acceleration forces which would exceed those typically measured when the footwear was in "normal" use. Even though the removal of the footwear from the wearer would prevent further tracking of the footwear, by allowing the footwear circuitry to sense and respond to the horizontal ("XY") and vertical ("Z") forces (collectively, the "XYZ forces"), and to self-activate, at least the footwear will be able to provide a "last known" location of the wearer at the time of his abduction.

DETAILED DESCRIPTION OF THE PREFERRED EMBODIMENTS

Figure 1:
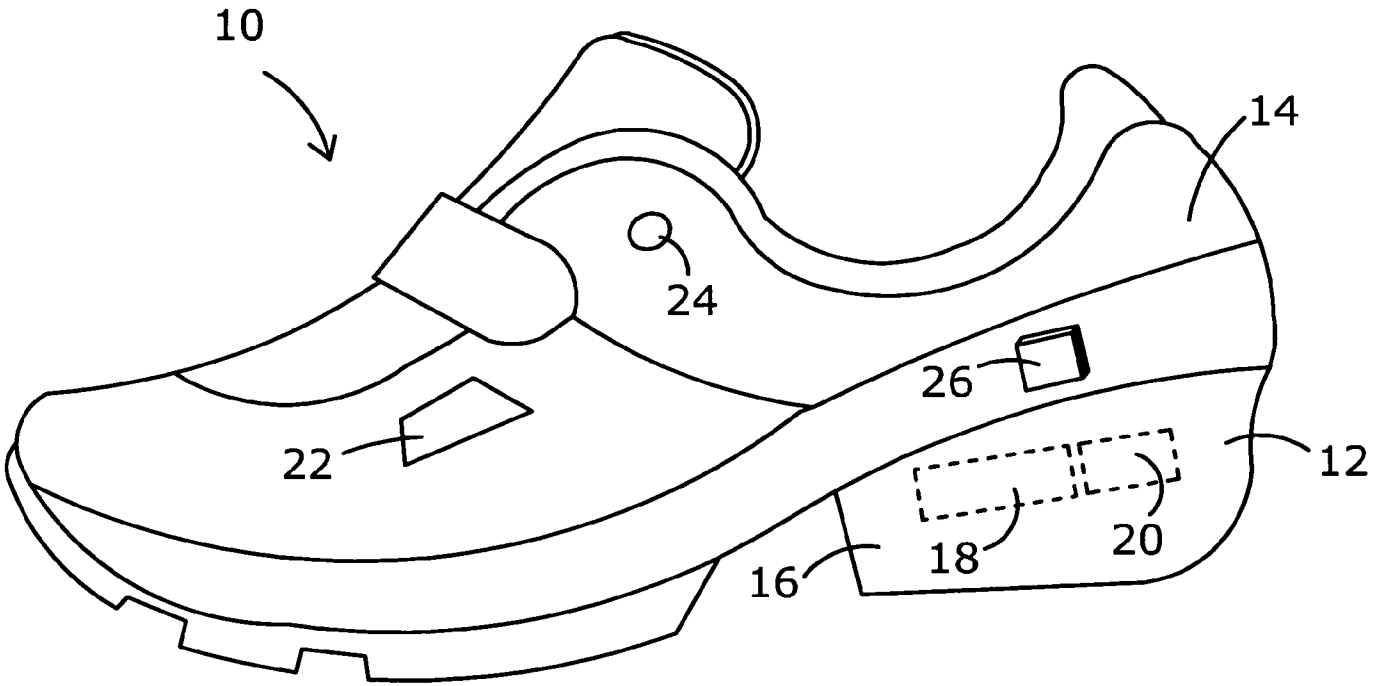
FIG. 1 is a perspective view of an athletic shoe including the present invention.

Referring to FIG. 1, the present invention relates to an article of footwear, preferably in the form of athletic footwear, such as the running shoe 10, as shown. The shoe 10 comprises a sole 12 and an upper portion or boot 14. A heel 16 is formed as a portion of the sole 12. In the preferred embodiment of the invention a cavity formed at the rear portion of the heel 16 houses electronic circuitry 18 (shown in shadow) and a battery 20 (shown in shadow) to power the electronics contained in the shoe 10, as will be more fully explained hereinafter.

The upper 14 may include, as an apparent design feature, a GPS antenna 22 which is connected to the electronic circuitry 18, and the shoe 10 may also include a covert alarm actuating button 24 which can be used to send out a "find me" signal, as described in the parent application. The shoe 10 also includes a connection means, such as a mini-USB port 26, which can be used to connect the shoe 10 to an external computer or a battery charger (neither of which are shown). The mini-USB port 26 is connected to the electronic circuitry 18, and it is used to for programming, uploading and downloading data, and to charge the battery 20.

Figure 2:
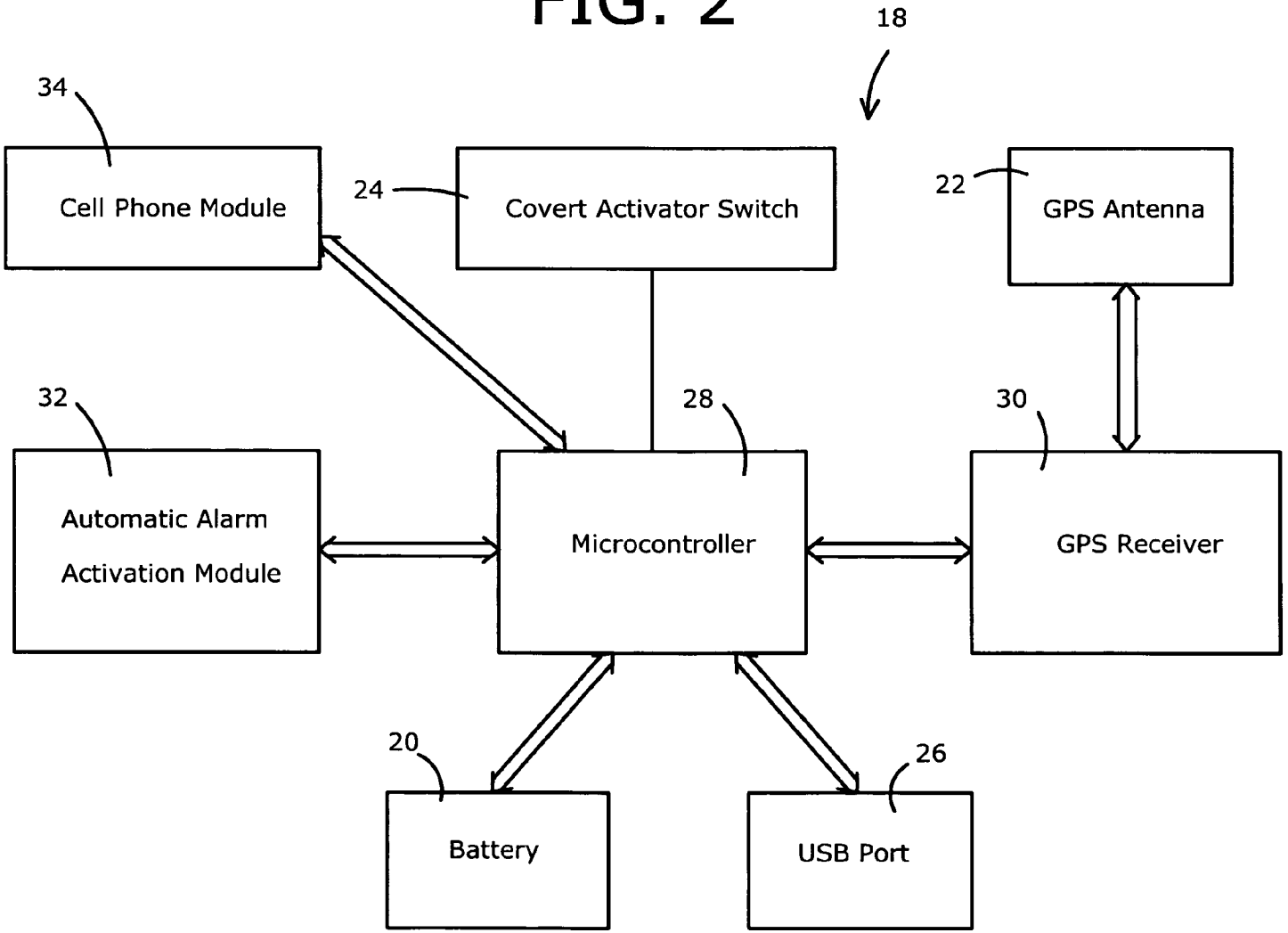
FIG. 2 is a block diagram of the invention of FIG. 1 illustrating the various internal modules which comprise the invention as well as the manner in which they are interconnected.

Referring now to FIG. 2, a block diagram of the electronic circuitry 18 is shown. As illustrated, in the preferred embodiment of the invention the electronic circuitry 18 includes a microprocessor or microcontroller 28, which is connected to the mini-USB port 26 and to a GPS receiver module 30. As shown, the GPS receiver module 30 is also connected to the GPS antenna 22, while the microcontroller 28 is also connected to the covert alarm activation button 24, to the battery 20, and to a automatic alarm activation module 32. As explained in the parent application referenced above, the electronic circuitry 18 can further include a cell phone module 34, which can be used, together with the covert alarm activator switch 24 and the microcontroller 28, to send out an alarm signal encoded with the GPS location data upon the selective activation of the covert alarm activator switch 24 by the wearer of the footwear 10.

In the preferred embodiment of the invention, the automatic alarm activation module ("AAAM") 32 is comprised of at least one accelerometer which is capable of measuring and acting on acceleration forces to which the shoe 10 is subjected. Depending on the type of accelerometer used in the AAAM 32, it will be able to measure and respond to acceleration forces in the horizontal ("XY") and vertical ("Z") directions. The accelerometer used in the preferred embodiment of the invention is able to measure and respond to XYZ forces.

As will be understood by those skilled in the art, any time that the footwear 10 is worn by a user, the AAAM 32 will be subject to acceleration forces. Accordingly, in order to avoid false alarm activations, while preserving the privacy of the wearer of the footwear, e.g. to prevent the AAAM 32 from randomly sending out an alarm signal causing the wearer's location to be tracked, particularly when the wearer does not wish to be tracked, the microcontroller 28 is programmed to ignore signals from the AAAM 32 which are indicative of acceleration forces which are lower than a preset limit. Thus, while the AAAM 32 will always be capable of sending automatic alarm activation signals, the signals which are below the programmed threshold will not result in the microcontroller actually sending out a "find me" alarm signal to the central monitoring station.

In an alternative embodiment of the present invention the microcontroller 28 can be programmed to prevent the AAAM 32 the transmission of the covert location encoded alarm unless the user first enters a sequence of button pushes using the covert activator button 24, to place the electronics 18 into an "armed" position which enables the footwear 10 to automatically respond to an activation signal from the AAAM 32. Alternatively (through another sequence of button pushes) the electronics can be placed back into the "manual activation only" mode. Through the use of such additional programming, the user is left in total control of whether or not the footwear will be able to automatically send out an alarm signal based on acceleration forces measured by the AAAM 32.

While the invention has been described in connection with specific embodiments and applications, the inventor does not intend to restrict the description to the examples shown. Persons skilled in the art will recognize that the above apparatus and methods may be modified or changed without departing from the general scope of the present description, the intention of the inventor being to include all such modifications and alterations in so far as they come within the scope of the appended claims or the equivalents thereof.

I claim:

1. An article of footwear comprising:

(a) a sole and a boot connected to said sole;

(b) location determining means for determining the location of said footwear;

(c) transmitter means for transmitting a signal encoded with said location of said footwear;

(d) a covert alarm activation switch which the wearer of the footwear can selectively activate to cause said transmitter means to transmit said signal encoded with said location of said footwear;

(e) automatic alarm activating means which can automatically respond to a condition indicative of the footwear being accelerated at a rate greater than normal walking, running, or driving accelerations, wherein such rate of acceleration is inconsistent with normal activity of a wearer, by causing said transmitter means to transmit said signal encoded with said location of said footwear irrespective of any manual activation of said covert alarm activation switch by the wearer of said footwear; and (f) control means for causing the transmission of the location encoded alarm signal by said footwear in response to a manual activation signal from said covert alarm activation switch or in response to an activation signal automatically generated by said automatic alarm activating means.

2. The article of footwear of claim 1, wherein said automatic alarm activating means comprises at least one accelerometer.

3. The article of footwear of claim 2, wherein said automatic alarm activating means is responsive to acceleration forces which exceed normal acceleration forces which would be experienced by a wearer in normal activities.

4. The article of footwear of claim 2, wherein said automatic alarm activating means is responsive to acceleration forces which exceed normal acceleration forces which would be experienced by a wearer in normal activities.

5. The article of footwear of claim 4, wherein said control means comprises a programmed microcontroller.

6. The article of footwear of claim 5, wherein said automatic alarm activating means is selectively enabled or disabled by external programming of said microcontroller.

7. The article of footwear of claim 4, further comprising means for enabling the wearer of said footwear to selectively enable and disable the ability of said automatic alarm activating means to initiate the transmission of an alarm signal.

8. The article of footwear of claim 7, wherein said means for enabling the wearer of said footwear to selectively enable and disable the ability of said automatic alarm activating means to initiate the transmission of an alarm signal is comprised of said covert alarm activation switch.

9. The article of footwear of claim 8, wherein said covert alarm activation switch is used to enter a sequence of button presses indicative of whether the wearer wishes to enable or disable the ability of said automatic alarm activating means to initiate the transmission of an alarm signal.

10. The article of footwear of claim 9, wherein said sequence of button presses indicative of whether the wearer wishes to enable or disable the ability of said automatic alarm activating means to initiate the transmission of an alarm signal is used to program said microcontroller.

* * * * *